US006581422B1

(12) United States Patent
Chang

(10) Patent No.: US 6,581,422 B1
(45) Date of Patent: Jun. 24, 2003

(54) LOCKING DEVICE FOR PORTABLE SAFE

(75) Inventor: Wei Yu Chang, Shin Chuang (TW)

(73) Assignee: Shyh Ru Metallic Industrial Corp., Shin-Chuang (TW)

( * ) Notice: Subject to any disclaimer, the term of this patent is extended or adjusted under 35 U.S.C. 154(b) by 0 days.

(21) Appl. No.: 10/061,248

(22) Filed: Feb. 4, 2002

(51) Int. Cl.[7] ..... E05B 65/52; E04C 3/16

(52) U.S. Cl. ..... 70/70; 70/71; 70/159; 292/124; 292/222; 292/224

(58) Field of Search ..... 292/220, 221, 292/124, 122, 98, 224, 222, 197; 70/69–74, 159, 162, 169, 173

(56) References Cited

U.S. PATENT DOCUMENTS 2,344,705 A * 3/1944 Krause
2,863,688 A * 12/1958 Endter
2,962,889 A * 12/1960 McConnell
2,993,358 A * 7/1961 Craig
4,365,490 A * 12/1982 Manzoni ..... 70/70
4,372,591 A * 2/1983 Cook et al. ..... 292/221
4,486,041 A * 12/1984 Takasaki ..... 292/221
4,875,721 A * 10/1989 Okamoto et al. ..... 292/29

* cited by examiner

*Primary Examiner*—Lloyd A. Gall
(74) *Attorney, Agent, or Firm*—Dennison, Schultz & Dougherty

(57) ABSTRACT

The present invention consists of a molded locking device and opening device together with a cover provided on the top of box, a hook to facilitate locking, and a locking apparatus inside the box opposite to the opening device, and locking device. The present invention is known for two distinctive features: (1) a window provided on the shell of the opening device and a track on the edge of window to facilitate the movement of convex plates, and (2) holes in the lifting plate and locking plate and a folding plate between the lifting plate and opening device. The folding plate connects to one end of the locking plate to trigger the movement of the latch provided on the top of locking plate. Therefore, the design of present invention simplifies the assembly procedure of opening plate, lifting plate and locking plate; thereby reduces the manufacturing costs.

3 Claims, 6 Drawing Sheets

LOCKING DEVICE FOR PORTABLE SAFE

BACKGROUND OF THE INVENTION

1. Field of the Invention

The present invention relates to an improved locking device for portable safe, and especially to such improved locking device that requires fewer processing procedures and is easy to assemble, thereby simplifies the manufacturing procedure and allows users to lock their portable safes easily.

2. Description of the Prior Art

As shown by FIG. 1 and FIG. 2, the conventional portable safe comprises a molded locking device 71 provided in the front of the box and an opening device 72. One end of the cover connects to the box; and a hook is provided in the other end of the cover to facilitate locking. A locking apparatus 8 is provided inside the box corresponding to the opening device 72 and locking device 71. The locking apparatus 8 consists of a lifting plate 81, a locking plate 82, and an elastic component 83. There is a latch 89 provided in the locking plate 82 that faces the hook oppositely and locks the safe when user closes the cover. User can move the opening device 72 to pull the latch 89 in order to close the safe temporarily; or move the latch 89 by the key to open the cover. However, the conventional safes are not ideal, because:

1. To assemble the opening device 72, the manufacturers have to fix a cover 79 by screw behind the opening device 72 in order to move the opening device 72 to its position.

2. The opening device 72 is activated through the square hole 721. The bronze bar 811 provided in the lifting plate 81 triggers the movement of the latch 89 and, consequently, manufacturers have to install a bronze bar 812 in the lifting plate 81 besides the bronze bar 811, which means extra work for manufacturers.

3. Manufacturers have to make a hole 821 on the locking plate 82 and install a folding plate 851 in the base plate 85. Consequently, both costs and workload increase.

The inventor has studied the foregoing drawbacks thoroughly and conducted numerous tests before the present invention came to being.

The purpose of present invention is to simplify the processing procedure of spare parts and assembly procedure of portable safes and allows users to lock their portable safes easily.

SUMMARY OF THE INVENTION

For the purposes stated in the preceding paragraphs, the present invention consists of a molded locking device and opening device. There is a cover provided on the top of box. A hook is provided in one end for the purpose of locking and a locking apparatus is provided inside the box opposite to the opening device and locking device. The design of present invention is known for two distinctive features: (1) there is a window provided on the shell of the opening device and a track on the edge of the window to facilitate the movement of parts. This design simplifies the assembly procedure of opening device and reduces the number of required spare parts, and (2) the locking apparatus consists of a lifting plate provided in the base plate, a locking plate, and an elastic component. There are holes in the lifting plate and locking plate; and a folding plate between the lifting plate and the opening device. The folding plate connects to one end of the locking plate to trigger the movement of the latch on the top of locking plate. Therefore, the design of present invention simplifies the assembly procedure of locking plate and reduces the manufacturing costs.

The present invention will be apparent in its contents of technique after reading the detailed description of the preferred embodiments of the present invention in reference to the accompanying drawings, wherein:

DETAILED DESCRIPTION OF THE PREFERRED EMBODIMENT

Figure 1:
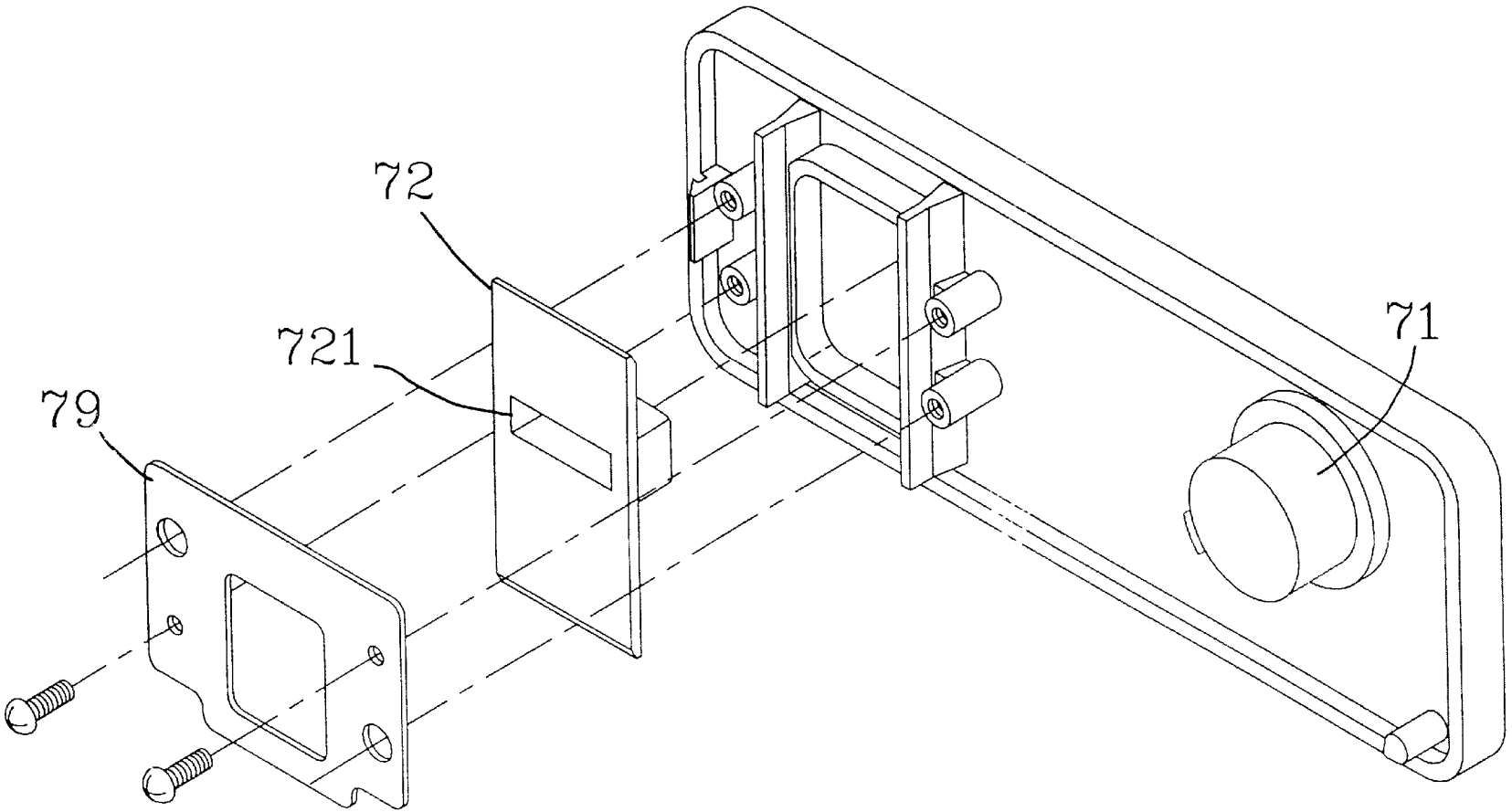
Fig.1 Prior Art
FIG. 1 is a sectional view showing the structure of conventional opening device.
Figure 2:
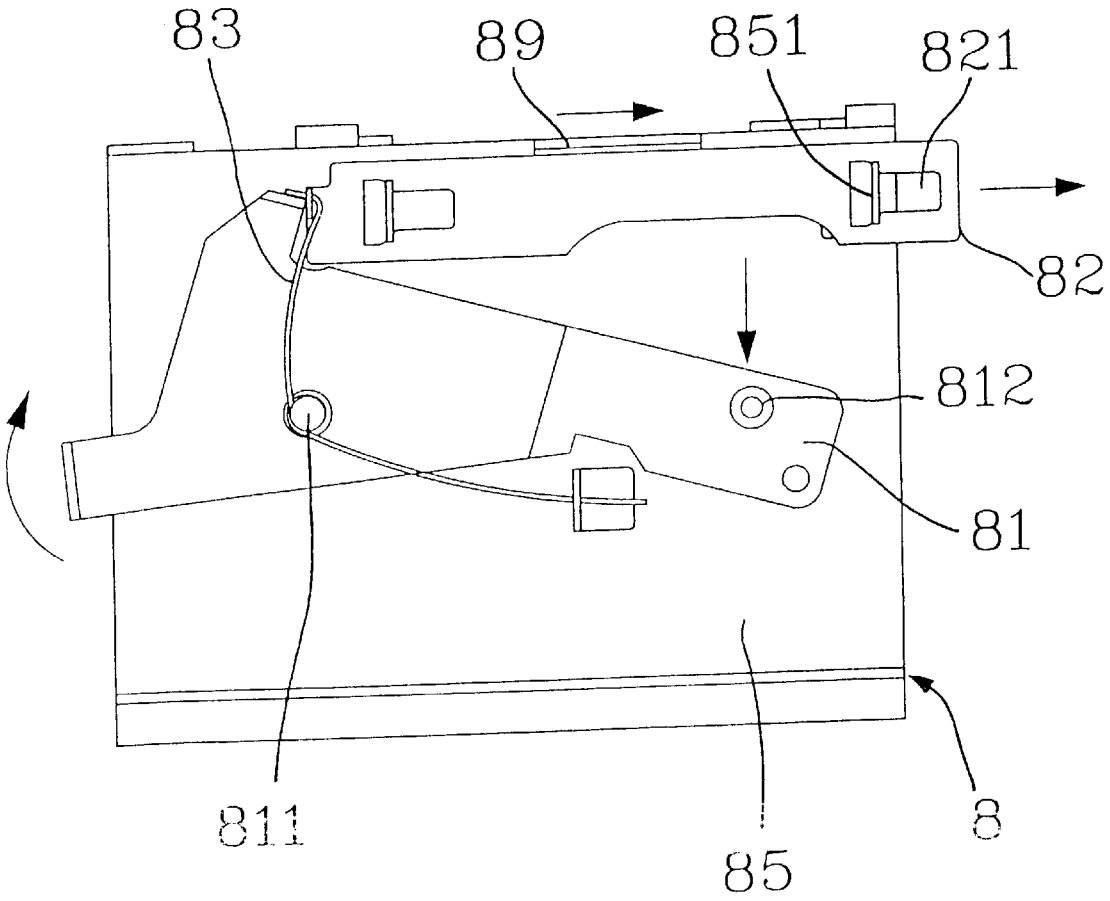
Fig. 2 Prior Art
FIG. 2 is a schematic view showing the assembly of the conventional locking apparatus.

As shown by FIGS. 3~6, the present invention comprises a molded locking device 2 and an opening device 3 provided in the front of box 1. There is a cover 11 provided on the top of box 1 with one end connecting to a hook 12. The locking apparatus 4 is provided inside the box corresponding to the opening device 3 and locking device 2. The present invention is known for two distinctive features as follows:

The opening device 3 is the first distinctive feature of present invention. There is a window 32 provided on the shell 31 and a track 33 provided on the edge of window to facilitate the movement of convex plate 34, thereby simplifies the assembly procedure of opening device 3 and reduce the number of required spare parts.

The locking apparatus 4 is the second distinctive feature of present invention. Lifting plate 42, locking plate 43, and elastic component 44 are provided in the base plate. There are holes 421, 431 on the lifting plate 42 and locking plate 43, respectively, and a folding plate 422 between the lifting plate 42 and opening device 3. The lifting plate 42 connects to one end 432 of the locking plate 43 to trigger the movement of latch 433. With the lifting plate 42 and locking plate 43, the assembly procedure is simplified and the number of required spare parts is reduced.

Figure 3:
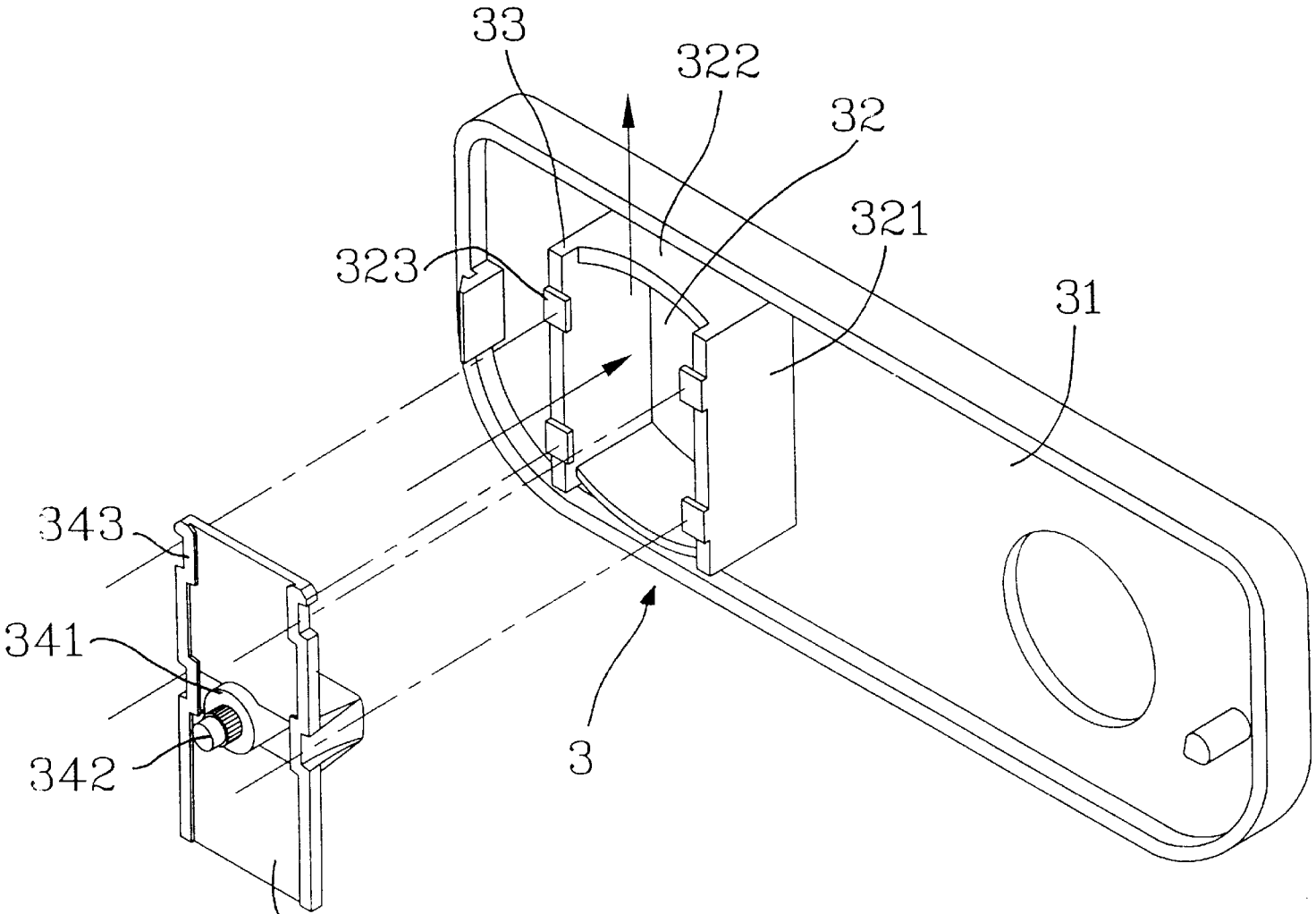
FIG. 3 is a sectional view showing the opening device of present invention.

As shown by FIG. 3, both vertical sides 321 of the window 32 are taller than the horizontal sides 322. Four projecting objects 323 are provided in the vertical sides 321 to form a track 33. There are four openings 343 provided on both edge of convex plate 34; and a projecting bar inside the convex plate 34 and opposite to the locking apparatus 4. The projecting bar is the round bar 341 on the center of convex plate 34 that connects to a metal bar 342.

Figure 4:
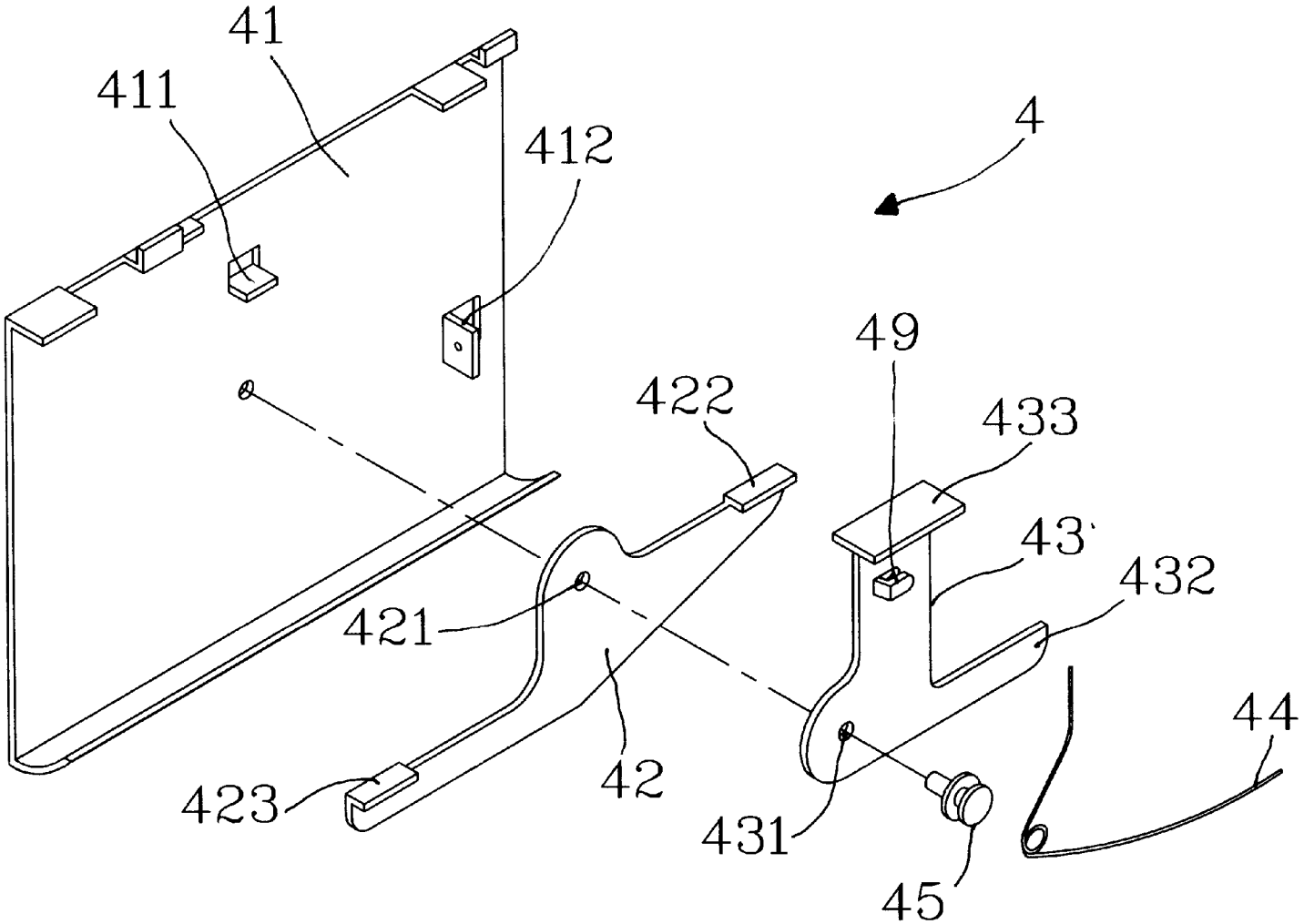
FIG. 4 is a schematic view showing the locking apparatus of present invention.
Figure 5:
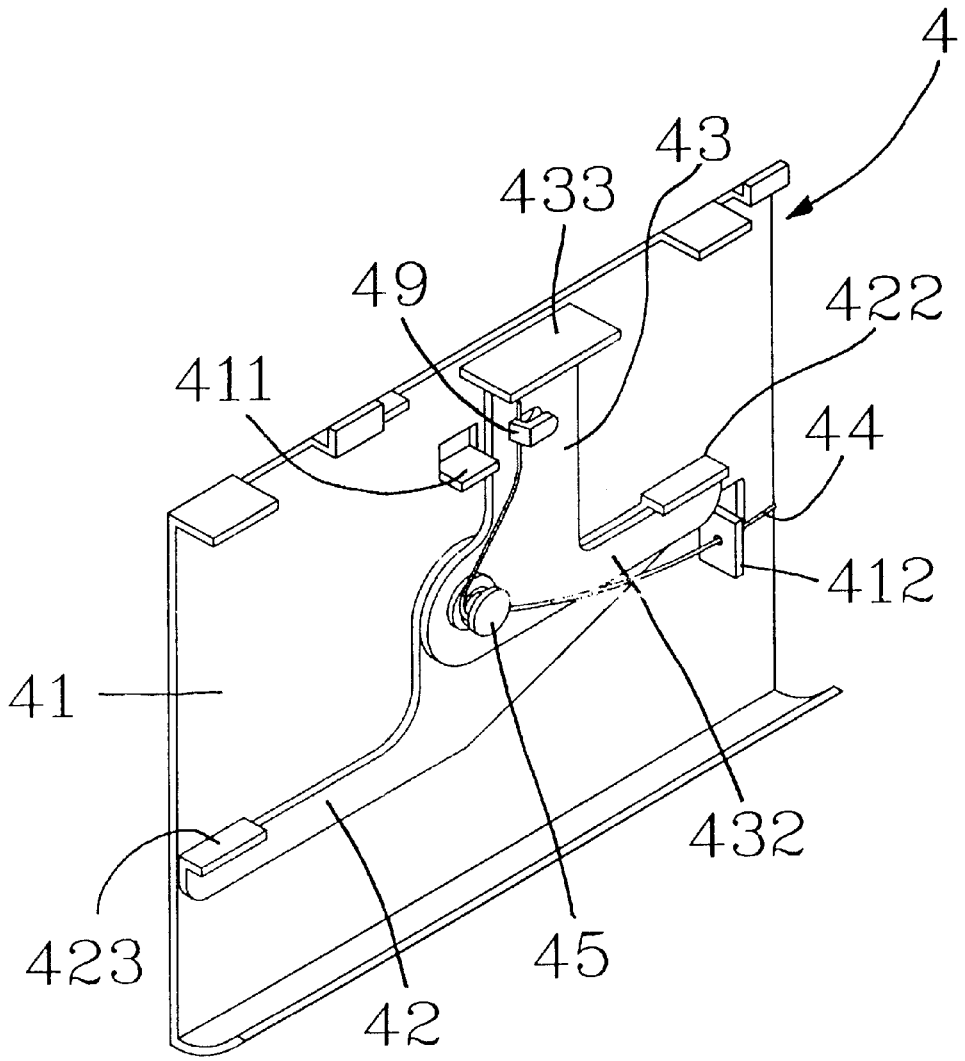
FIG. 5 is a schematic sectional view showing the assembly of the locking device of present invention.

FIG. 4 and FIG. 5 show the motion of the locking apparatus 4 of present invention as follows:

There is a hole 421 on the center of the scale-shaped lifting plate 42. Two folding plates 422 and 423 are on both ends; and together with the inner plate 21 of the opening device 3 and locking device 2.

There is a hole 431 in the lower area of L-shaped locking plate 43. The lower arm 432 stretches horizontally below the folding plate 422 of the lifting plate 42. There is a latch 433 on the top.

A bronze bar 45 passes through the holes 431 and 421 of the locking plate 43 and lifting plate 42, and is fixed on the base plate 41.

On the base plate 41 there is a folding plate 411 pushing the locking plate 43 and an elastic component 44 passing through another folding plate 412. The folding plates 411 and 412 are located on the upper left corner and lower right corner of the base plate 41.

One end of the elastic component 44 passes through the folding plate 412 and the other end is fixed in the folding plate 49.

Figure 6:
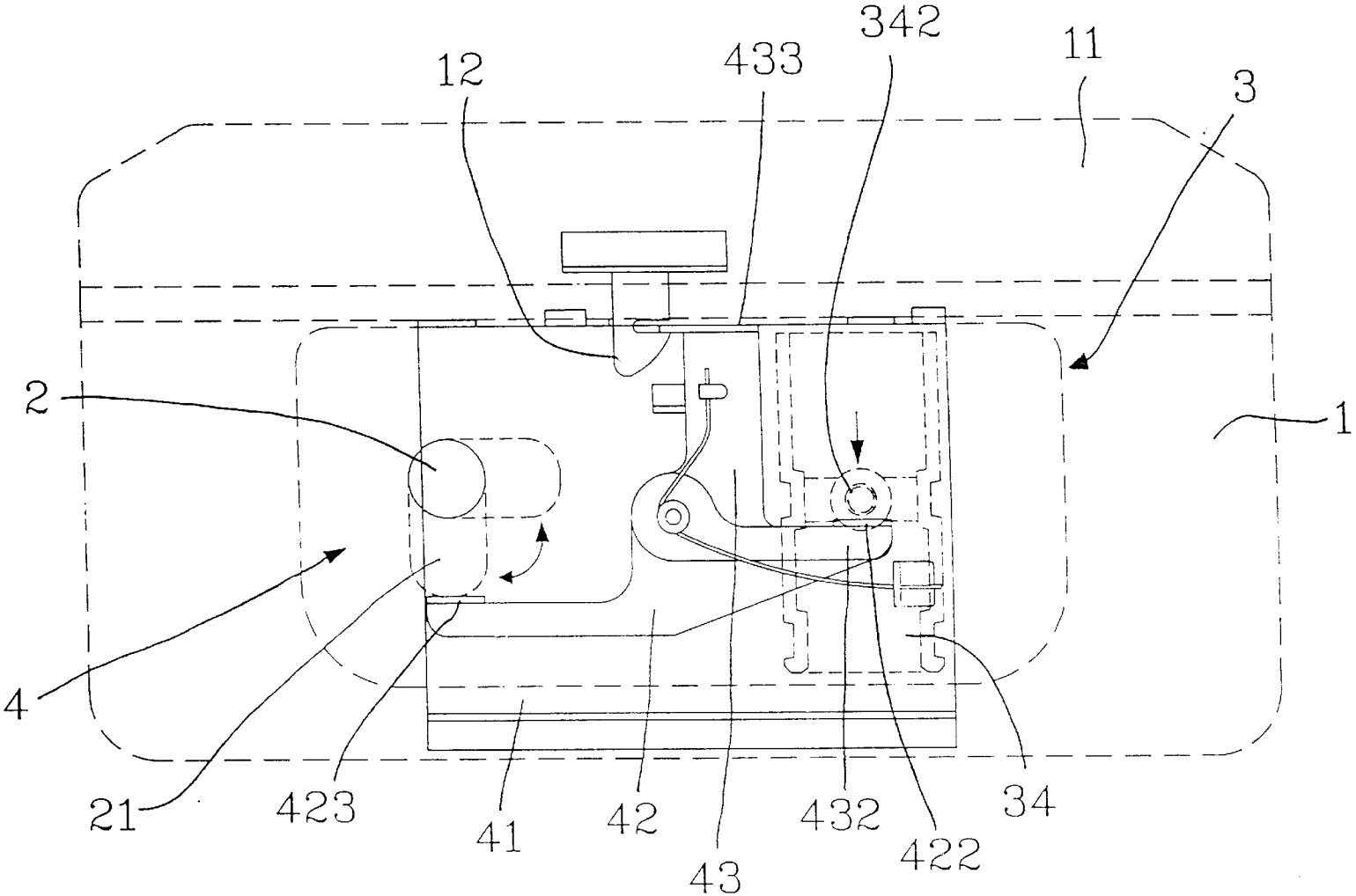
FIG. 6 is a schematic view showing the application of present invention.

As shown by FIG. 6, manufacturers can use minimum number of spare parts to produce the opening device 3 and locking apparatus 4, thereby simplifies the assembly procedure and reduces production costs. Users close the cover 11 by the locking device 2. To open the safe, users can insert the key to force the inner plate 21 away from the folding plate 423 of the lifting plate 42. When the cover 11 is closed temporarily, users can use the convex plate 34 to press the folding plate 422 and trigger the movement of locking plate 43 in order to open the safe.

By the above stated structural combinations, the present invention solves the problems related to the locking device of conventional safes and is valuable industrially. The inventor hereby submits application for patent.

The present invention has been described in conjunction with the preferred embodiment. To those skilled in the art, modification may be made in the invention without departing from the spirit and scope of the subject invention as set forth in the claims below.

Having thus described my invention, what the inventor claims as new and desire to be secured by Letters Patent of the United States are:

1. An improved lock for a portable safe, comprising:

a molded locking device;

an opening device, and a box, wherein said molded locking device and said opening device are disposed in front of said box;

a hook disposed on a cover to said box;

a locking apparatus disposed inside said box;

wherein said locking apparatus comprises a lifting plate, a locking plate, a base plate, and an elastic component, wherein said locking plate and said lifting plate are pivotally connected to said base plate by a bar along an axis, and said elastic component is connected to said locking plate and provides for a biased forced during pivotal movement of said locking plate and said lifting plate;

said locking plate further comprises a latch which engages said hook, and an arm extending sideways from said locking plate; and said lifting plate further comprises a folding plate, wherein said folding plate engages said arm of said locking plate to move said locking plate thereby moving said latch to disengage said hook.

2. An improved lock according to claim 1, wherein said opening device further comprises a convex plate movable within a window in said opening device, the convex plate having a metal bar which engages said folding plate of said lifting plate to facilitate pivotal movement of said lifting plate.

3. An improved lock according to claim 2, wherein said lifting plate is scale shaped, said lifting plate further comprises a second folding plate opposite said folding plate, wherein said locking plate is L-shaped, wherein said base plate comprises a folding plate for receiving one end of said elastic component, and wherein said window of said opening device further comprises four projecting objects on longer sides thereof.

* * * * *